US006693064B2

(12) United States Patent
Bünemann et al.

(10) Patent No.: US 6,693,064 B2
(45) **Date of Patent: *Feb. 17, 2004**

(54) HYDRAULIC FLUIDS

(75) Inventors: Thomas Friedrich Bünemann, Hague (NL); Arie Dick Kardol, Waddinxveen (NL); Abraham Cornelis de Mooij, RS Gouda (NL)

(73) Assignee: Unichema Chemie B.V., Gouda (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,154

(22) PCT Filed: Mar. 26, 1997

(86) PCT No.: PCT/EP97/01608

§ 371 (c)(1),
(2), (4) Date: Oct. 13, 1998

(87) PCT Pub. No.: WO97/39086

PCT Pub. Date: Oct. 23, 1997

(65) Prior Publication Data

US 2002/0193259 A1 Dec. 19, 2002

(30) Foreign Application Priority Data

Apr. 16, 1996 (EP) ..... 96201017

(51) Int. Cl.[7] ..... C10M 105/38; C10M 169/04
(52) U.S. Cl. ..... 508/485; 252/79
(58) Field of Search ..... 508/485; 560/129; 252/79

(56) References Cited

U.S. PATENT DOCUMENTS 4,144,183 A 3/1979 Koch et al.
4,178,261 A * 12/1979 Dhein et al. ..... 508/485
4,234,497 A 11/1980 Honig
4,477,383 A * 10/1984 Beimesch et al. ..... 508/485

FOREIGN PATENT DOCUMENTS

| | | | |
|---|---|---|---|
| DE | 2520459 | | 11/1975 |
| DE | 2656078 | | 6/1977 |
| DE | 3927155 | | 2/1991 |
| EP | 0 066 935 | | 12/1982 |
| EP | 0480479 | A2 * | 4/1992 |
| EP | 0 612 831 | | 8/1994 |
| GB | 1 441 918 | | 7/1976 |
| JP | 56-131548 | | 10/1981 |
| JP | 1-311192 | | 12/1989 |

OTHER PUBLICATIONS

Chemical Abstracts, vol. 75, No. 20, Nov. 15, 1971 Columbus, Ohio, US; abstract No. 119748, Cottington, Robert L. et al: "Lubricants from mixed pentaerythritol esters of 2–ethylhexanoic and isostearic acids" XP002032633 see abstract & asle (Amer. Soc. Lubric. Eng.), Trans. (1971), 14 (3), 163–9 Coden: ASLTA2, 1971.

* cited by examiner

*Primary Examiner*—Margaret Medley
(74) *Attorney, Agent, or Firm*—Pillsbury Winthrop LLP

(57) ABSTRACT

The invention relates to compositions comprising an ester of a polyol and a mixture of fatty acids, wherein at least a part (I) the esterified fatty acids has a chain length of 5–12 carbon atoms and another part (II) of the esterified fatty acids has a chain length of 16–22 carbon atoms, and wherein the composition has a viscosity of 7000 $mm^2/s$ or less, when tested according to ASTM (D2531). Such compositions have unexpected good low temperature properties, in particular a good rheology after having been kept for a prolonged time at a low temperature (e.g. at −30° C.). These compositions are suitable for use as (part of) hydraulic fluid in applications at low temperatures.

8 Claims, No Drawings

HYDRAULIC FLUIDS

CROSS REFERENCE TO RELATED APPLICATION

This application is the National Phase of International Application No. PCT/EP97/01608, filed Mar. 26, 1997, which designates the United States. The International application, in its entirety, is incorporated herein by reference.

The present invention relates to hydraulic fluids. More in particular, the invention relates to ester-based hydraulic fluids having improved low temperature properties.

Hydraulic systems are used in a wide variety of mechanical equipment, such as automobiles, trucks, cranes, trains, other transport equipment, agricultural equipment, ships and marine equipment (all mobile systems) and non-mobile systems such as in factories and railways. Such hydraulic systems contain a hydraulic fluid, which can be based on a petrochemical fluid (traditional) or an ester/oleochemical basis (more environmentally acceptable).

In a number of applications, these hydraulic systems are subjected to low temperatures, of either the environment or the hydraulic system itself. This is especially the case when hydraulic systems are used in countries near or within the arctic circles. It is a known fact that a number of properties of hydraulic fluids change upon changing temperature of the hydraulic fluid. It is also known that low temperatures have generally an adverse effect on a number of properties of the hydraulic fluid, such as the pourpoint and the (dynamic) viscosity being too high and an insufficient low temperature stability, etcetera.

For hydraulic fluids based on petrochemical fluids, a number of solutions have been proposed to improve some of the low temperature properties. For example by the use of additives such as pourpoint depressants. However, up till now, it is known that such additives cannot be used in hydraulic fluids based on esters/oleochemicals, because they are either incompatible with the esters/oleochemicals, or such additives have an insufficient effect (the desired effect being good properties at low temperatures).

Hence, there was a need for an ester/oleochemical-based hydraulic fluid having improved low temperature properties, when compared with conventional ester/oleochemical based hydraulic fluids. The "ester/oleochemical based fluids" are herein to be understood as to be fluids, suitable for application as a hydraulic (base) fluid for use in a hydraulic system, in which at least the major part (i.e. more than 50% by weight) is composed of an ester of a polyol and a carboxylic acid. It is a further object of the invention that the ester/oleochemical based hydraulic fluid still has satisfactory properties at "normal-use" temperatures, in addition to the improved low temperature properties. An important property relating to "normal use" temperatures is the kinematic viscosity at 40° C. and 100° C. By improved low temperature properties is meant that the properties of the hydraulic fluid are improved in at least one aspect, preferably being low temperature stability.

By low temperature stability is meant that the liquid still has suitable properties after being kept at a low temperature for a considerable amount of time (a number of days). A way of quantifying low temperature stability is by the test method according to ASTM D2532. In short, the method consists of measuring the (kinematic) viscosity of the liquid, after it has been kept at −30° C. for 168 hours. The viscosity so measured should then be below a specified limit.

It has now been found that the above objectives can be met by a composition comprising an ester of a polyol and a mixture of fatty acids, wherein at least a part (I) of the esterified fatty acids has a chain length of 5–12 carbon atoms and another part (II) of the esterified fatty acids has a chain length of 16–22 carbon atoms, and wherein the composition has a viscosity of 7000 $mm^2/s$ or less, when tested according to ASTM (D2532). Such an ester is often referred to as a mixed ester, meaning that (on average) each ester molecule contains at least two different carboxylic acid moieties. Said short chain fatty acids as well as long fatty acids can be straight chain or branched chain (or mixtures thereof).

Preferably, the composition has a viscosity of 5000 $mm^2/s$ or less, when tested according to ASTM (D2532).

For a combination of good low- and high temperature properties, it is preferred that the ratio short chain fatty acid:long chain fatty acid in the mixed esters should be between 2:1 and 1:20 by weight. It was found that for many cases a relatively small amount of short chain fatty acids is needed for obtaining the desired effect, and hence, it is even more preferred that the above referred ratio is between 1:1 and 1:10 by weight.

Although the compositions according to the invention are preferably free of additives such as an emulsifier or a pourpoint depressant, specific additives such as an anti-oxidant (e.g. aminic or phenolic type anti-oxidants) viscosity index (VI) improver (e.g. polymethacrylate compounds), an anti-wear compound (e.g. dithiophosphates, calcium sulphonates, barium sulphonates) and an anti-foam compound (e.g. modified dimethyl polysiloxanes) may be added to the compositions.

The compositions according to the invention preferably comprise esters of polyols selected from the group consisting of TMP (trimethylol propane), PE (pentaerythritol), NPG (neopentylglycol), di-TMP, tri-TMP, di-PE, tri-PE. A most preferred polyol is TMP.

The polyols are preferably esterified with mixtures comprising short chain fatty acids having branched or straight chain C8 or C10 fatty acids, or mixtures thereof. For the long-chain part, it is preferred that these comprise oleic acid or isostearic acid.

Preferably, the esters according to the invention have an acid value of less than 5.0, preferably less than 1.0 mg KOH/g.

Preferably, the composition to be used as a hydraulic fluid comprises at least 75%, more preferably, at least 85% by weight of the mixed esters as above defined. Most preferred is a hydraulic fluid comprising at least 95% by weight of the esters as defined above.

Although for some cases the compositions according to the invention can be used as such in a hydraulic system, it is also possible that such compositions are used in the manufacture of hydraulic fluids, by e.g. compounding them with other fluids or additives.

A further embodiment of the invention is the use of the compositions according to the above in hydraulic equipment. Such hydraulic equipment may be part of a mobile system.

The invention further comprises a method for the manufacture of hydraulic fluids, comprising the esterification of a polyol with a mixture of fatty acids, wherein that at least a part of the fatty acids has a short chain length (5–12 carbon atoms) and another part of the fatty acids has a long chain length (16–22 carbon atoms), and wherein the fatty acid ester is present in the composition in an amount of at least 75% by weight, based on the total composition, and optionally mixing the resulting mixed ester with other components. Said short chain fatty acids as well as long fatty acids can be straight chain or branched chain (or mixtures thereof).

The invention is further illustrated by the following examples, which are not to be understood as limiting the invention thereto.

EXAMPLES

Example 1

A four neck flask having an internal volume of 2 litre was equipped with a stirrer, a thermometer/temperature-control device, a nitrogen gas blower and a Dean and Stark water separator connected to a reflux condenser. Into the flask was charged 220.1 g (1.64 mole) of trimethylolpropane, 165 g (0.96 mole) of a octanoic/decanoic acid mixture (in a weight ratio of about 55:45) and 1115 g (3.97 mole) oleic acid. The mixture was esterified, heated by a mantle heater in a stream of nitrogen. After supplying heat for approximately one hour, starting at room temperature, a temperature of 160° C. was reached and the reaction water was distilled off. The temperature was gradually elevated to 250° C. and 90 ml of water was collected. At this point the water separator was removed and vacuum was applied at the reaction mixture. The reaction was completed in a total reaction time of approximately 7 hours. A total of 75 g organic light fractions was distilled off during the last stage of the reaction. Finally the ester product was filtered in order to remove any mechanical impurities.

GLC analysis of the ester so-obtained showed that it contained 13% by weight of the C8/C10 mixture (ratio: 56.9:43.1) and 87% by weight of oleic acid (among the oleic fraction are minor amounts of other long chain fatty acids).

The properties of the ester are set out in table 1.

Example 2

A four neck flask having an internal volume of 2 litre was equipped with a stirrer, a thermometer/temperature-control device, a nitrogen gas blower and a Dean and Stark water separator connected to a reflux condenser. Into the flask was charged 227.4 g (1.70 mole) of trimethylolpropane, 164 g (1.14 mole) of 2 ethylhexanoic acid and 1109 g (3.95 mole) oleic acid. The mixture was esterified, heated by a mantle heater in a stream of nitrogen. After approximately one hour, a temperature of 160° C. was reached and the reaction water was distilled off. The temperature was gradually elevated to 250° C. and 90 ml of water was collected. At this point the water separator was removed and vacuum was applied at the reaction mixture. The reaction was completed in a total reaction time of approximately 7 hours. A total of 75 g organic light fractions was distilled off during the last stage of the reaction. Finally the ester product was filtered in order to remove any mechanical impurities.

GLC analysis of the ester so-obtained showed that it contained 13.4% by weight of the 2-ethylhexanoic acid and 86.6% by weight of oleic acid (among the oleic fraction are minor amounts of other long chain fatty acids).

The properties of the ester so obtained are set out in table 1.

TABLE 1

Properties of fluids according to the invention (ex. 1 and 2) and a comparative.

| Example | 1 | 2 | comparative |
|---|---|---|---|
| polyol | TMP | TMP | TMP |
| short chain fatty acid | $C_8/C_{10}$ | 2-EH | not present |
| long chain fatty acid | $C_{18:1}$ | $C_{18:1}$ | $C_{18:1}$ |
| cloudpoint (° C.) | −32 | −25 | −24 |

TABLE 1-continued

Properties of fluids according to the invention (ex. 1 and 2) and a comparative.

| Example | 1 | 2 | comparative |
|---|---|---|---|
| pourpoint (° C.) | −56 | −50 | −50 |
| viscosity ($mm^2/s$) ASTM-D2532 30° C./168 h) | 3900 | 4900 | could not be determined (seeding) |
| kin. visc. 40° C. ($mm^2/s$) | 43.3 | 44.5 | 47 |
| kin. visc. 100° C. ($mm^2/s$) | 9.0 | 8.8 | 9.6 |

TMP is Trimethylol propane.
$C_8/C_{10}$ is a mixture of fatty acids having 8 or 10 carbon atoms.
2-EH is 2-ethylhexanoic acid (branched C8).
$C_{18:1}$ is (predominantly) oleic acid.

What is claimed is:

1. A hydraulic fluid composition comprising at least 75% by weight, based on the total composition, of at least one ester formed by the reaction of (i) at least one polyol selected from the group consisting of trimethylol propane, pentaerythritol, neopentyl glycol, di-trimethylol propane, tri-trimethylol propane, di-pentaerythritol, tri-pentaerythritol; with (ii) a mixture of fatty acids consisting of a part (I) selected from the group consisting of straight or branched chain C8 and C10 acids or mixture thereof and a part (II) oleic acid, wherein the ratio of esterified acids (I):(II) is in the range 2:1 to 1:20; and wherein said hydraulic fluid has a viscosity of 7000 $mm^2/s$ or less, when measured at −30° C. after being held at −30° C. for 168 hours, and further comprising at least one additive selected from the group consisting of anti-oxidants, viscosity index improvers, anti-wear compounds and anti-foam compounds.

2. The composition according to claim 1, wherein the composition has a viscosity of 5000 $mm^2/s$ or less, when measured at −30° C. after being held at −30° C. for 168 hours.

3. The composition according to claim 1, wherein the polyol is trimethylol propane.

4. The composition according to claim 1, wherein the ratio between (I):(II) is between 1:1 and 1:10 by weight.

5. The composition according to claim 1, whereon the composition is substantially free of additives selected from the group consisting of emulsifiers and pour point depressants.

6. The composition according to claim 1, wherein the fluid comprises at least 85% by weight, based on the total composition, of said ester.

7. The composition according to claim 1, wherein the fluid comprises at least 95% by weight, based on the total composition, of said ester.

8. The composition according to claim 1, wherein the composition has a viscosity of 5000 $mm^2/s$ or less, when measured at −30° C. after being held at −30° C. for 168 hours and wherein the ratio between (I):(II) is between 1:1 and 1:10 by weight.

* * * * *